US008777098B1

(12) United States Patent
Spencer

(10) Patent No.: US 8,777,098 B1
(45) Date of Patent: Jul. 15, 2014

(54) COLLECTION CANISTER

(71) Applicant: Wayne Spencer, Tampa, FL (US)

(72) Inventor: Wayne Spencer, Tampa, FL (US)

( * ) Notice: Subject to any disclaimer, the term of this patent is extended or adjusted under 35 U.S.C. 154(b) by 0 days.

(21) Appl. No.: 14/038,496

(22) Filed: Sep. 26, 2013

Related U.S. Application Data

(63) Continuation of application No. 13/771,649, filed on Feb. 20, 2013, now Pat. No. 8,651,367, and a continuation of application No. 13/422,982, filed on Mar. 16, 2012, now Pat. No. 8,646,682.

(51) Int. Cl.
*A47G 29/00* (2006.01)
*A45C 1/12* (2006.01)

(52) U.S. Cl.
CPC ..... *A45C 1/12* (2013.01)
USPC ..... 232/5; 232/1 D; 232/1 E; 232/44; 109/52; 109/66; 220/476

(58) Field of Classification Search
USPC ..... 232/4 R, 1 E, 1 D, 43.1, 19, 44, 5; 220/476, 478, 480, 481, 810; 109/50, 109/52, 66; 446/8
See application file for complete search history.

(56) References Cited

U.S. PATENT DOCUMENTS

| | | | | |
|---|---|---|---|---|
| 471,918 | A * | 3/1892 | Van Pelt | 232/28 |
| 2,754,991 | A * | 7/1956 | Hagerty et al. | 220/481 |
| 4,671,455 | A * | 6/1987 | Stockman | 232/1 D |
| 5,465,909 | A * | 11/1995 | Roth | 232/1 D |
| 6,920,835 | B1 * | 7/2005 | Johnson | 109/68 |
| 7,185,802 | B2 | 3/2007 | Spencer | |
| 7,389,910 | B2 | 6/2008 | Spencer | |
| 7,850,065 | B2 * | 12/2010 | Lederer | 232/44 |

* cited by examiner

*Primary Examiner* — William Miller
(74) *Attorney, Agent, or Firm* — Edward P Dutkiewicz

(57) ABSTRACT

A collection canister having a wall mounting plate having a baffle. The collection canister having a first half having a back component and a pair of side components. The first half being removably coupled to the wall mounting plate.
There is a second half having a front component and a pair of side ends. The second half is removably coupled to the first half in a clam shell manner. There is a locking bar which secures the plate and halves together. There is a contents viewing window and a display window, for advertising.

10 Claims, 9 Drawing Sheets

FIG. 8
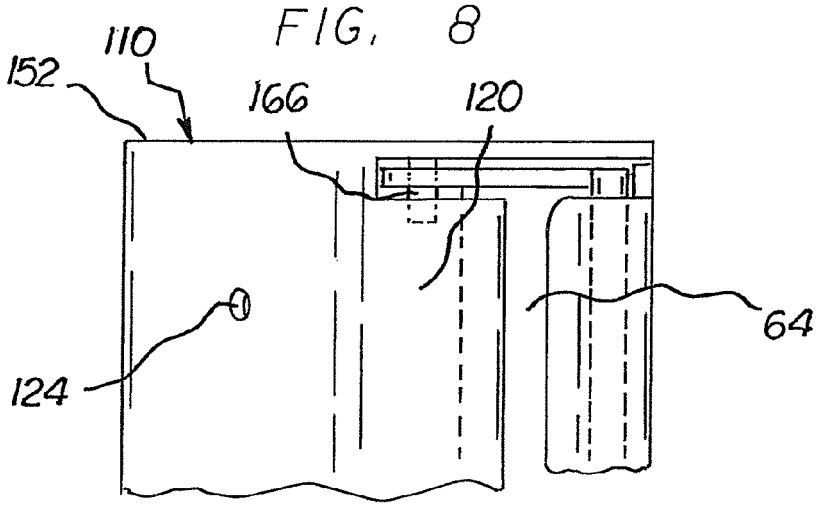
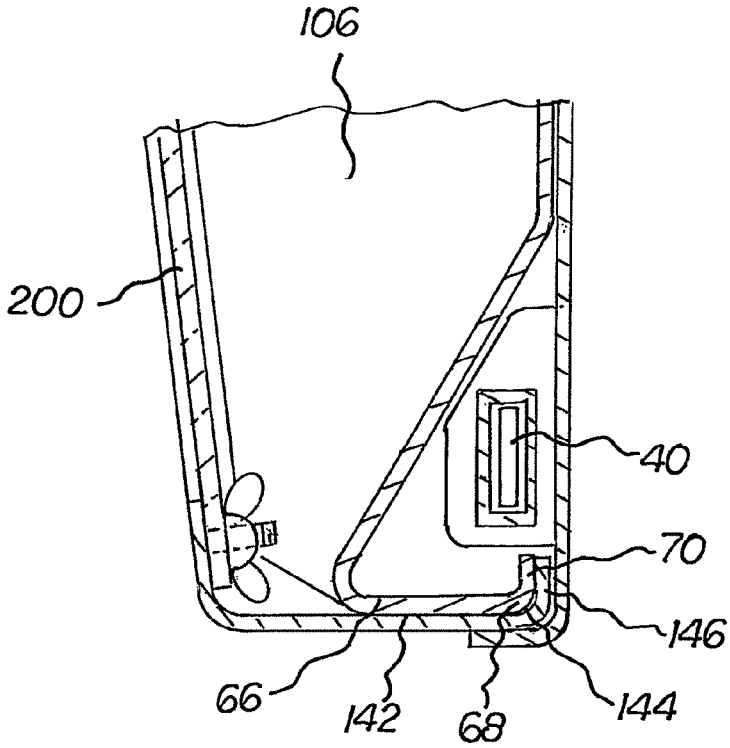
FIG. 9

COLLECTION CANISTER

RELATED PATENT APPLICATIONS

This application is a continuation in part, based upon U.S. Utility patent application Ser. No. 13/771,649, filed on Feb. 20, 2013, and presently pending, which is a continuation in part of Utility patent application Ser. No. 13/422,982 filed Mar. 16, 2012 which is presently pending. This application claims the priority of the parent application being the Ser. No. 13/771,649 which has been issued as U.S. Pat. No. 8,651,367, and the intervening CIP application, being the Ser. No. 13/422,982 which has been issued as U.S. Pat. No. 8,646,682.

BACKGROUND OF THE INVENTION

Rule 1.78(F) (1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a collection canister and more particularly pertains to an efficient and easy to use contributions collection device.

DESCRIPTION OF THE PRIOR ART

The use of devices to collect contributions is known in the prior art. More specifically, devices to collect contributions previously devised and utilized for the purpose of effectuating collections of charitable donations are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe a collection canister that provides an efficient and easy to use contributions collection device.

In this respect, the collection canister, according to the present invention, substantially departs from the conventional concepts and designs of the prior art, and in doing so provides an apparatus primarily developed for the purpose of providing an efficient and easy to use contributions collection device.

Therefore, it can be appreciated that there exists a continuing need for a new and improved collection canister which provides an efficient and easy to use contributions collection device. In this regard, the present invention substantially fulfills this need.

SUMMARY OF THE INVENTION

In view of the foregoing disadvantages inherent in the known types of devices to collect contributions now present in the prior art, the present invention provides an improved collection canister. As such, the general purpose of the present invention, which will be described subsequently in greater detail, is to provide a new and improved collection canister which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

To attain this, the present invention is herein described. The collection canister essentially comprises several components, in combination.

There is a wall mounting plate. The wall mounting plate is fabricated of a rigid material. The wall mounting plate has a generally rectilinear configuration. The wall mounting plate has a wall contact surface and an outward surface, with a thickness there between. The thickness of the wall mounting plate forms a side edge. The wall mounting plate has an upper end and a lower end, with a height. The wall mounting plate has a first width. The wall mounting plate upper end has an lip which is angled downward between about five degrees and eighty degrees.

The lip of the wall mounting plate and the outward surface of the wall mounting plate form a recess there between. The lip of the wall mounting plate has a second width, with the second width of the lip being less than the first width of the wall mounting plate.

The height of the wall mounting plate has a plurality of slots there through. The lower end of the wall mounting plate has a pair of generally parallel outwardly extending tabs, with each tab having an outward side edge and each tab having an inward side edge. Each tab has a locking bar aperture there through. The distance between each outward tab side edge being the second width.

There is locking bar channel. The locking bar channel has a rectangular hollow tubular configuration. The locking bar channel is located between the inner side edges of each of the lower end tabs. The locking bar channel is fixedly attached to the tabs by way of a weldment.

The lower end of the wall mounting plate has an outwardly disposed lip, with the lip having the first width. The outwardly disposed lip of the lower end of the wall mounting plate is oriented generally perpendicular to the outward surface of the wall mounting plate.

There is a first half. The first half is fabricated of a rigid material. The first half has a back component and a pair of mirror image side components. The back component has a generally rectilinear configuration, with an upper end and a lower end. The back component has an wallward surface and an inner surface, with a thickness there between.

The upper end of the first half has an outwardly angled baffle coupled there to with the angle of the outwardly angled baffle being between about five degrees and eighty degrees.

The lower end of the first half is oriented at an outward angle relative to the upper end of the first half, with the angle being between about five degrees and eighty degrees. The lower end of the first half has a wallwardly disposed strip, with the strip being disposed generally perpendicular to the upper end of the first half. The strip has a wallward extent, with the wallward extent having a generally upwardly disposed second lip. The second lip is oriented generally parallel to the upper end of the first half.

The mirror image side components each have a wallward end, an outward end, an upper end, and a lower end. Each side component has an outward surface and an inner surface, with a thickness there between. The wallward end of each side component is continuous with the back component of the first half. The upper end of each side component has a stepped configuration, with the step of each upper end of each side component having an offset slot there through. The outward end of each side component is located at an angle relative to the wallward end of each side component, with the side component outward end angle being between about ten degrees and forty five degrees. Each side component outward end has an inwardly disposed lip, with the lip being oriented generally perpendicular to the wallward end of the side component. Each side component has a beveled outward lower end. Each side component wallward lower end has a locking bar aperture there through.

There is a second half. The second half is fabricated of a rigid material. The second half has a front component and a pair of mirror image side components. The second half has an inner surface and an outer surface. The front component has a generally rectilinear configuration with an upper end, a lower end, and a pair of side ends. The front component has an inner surface and an outer surface.

The upper end of the front component of the second half is angled wallwardly relative to the lower end of the second half. The upper end of the front component of the second half has a wallwardly angled and then outwardly angled baffle. The lower end of the second half is angled wallwardly relative to the wall mounting plate. The upper end of the front component of the second half has a pair of stud holes there through. The lower end of the front component of the second half has a rectangular shaped contents viewing aperture there through. The contents viewing aperture having a surrounding lip, with the lip having an inner surface and an outer surface. The inner surface of the lip of the lower end of the second half has a pair of threaded studs located there on, with each of the threaded studs having an associated wing nut.

The lower end of the front component of the second half also having a generally rectangular shaped wallwardly disposed lip. The wallwardly disposed lip of the lower end of the front component having a wallwardmost extent. The wallwardly disposed lip of the lower end is oriented generally perpendicular to the wall mounting plate. The wallwardmost extent of the wallwardly disposed lip of the lower end of the front component has an upwardly disposed lip. The upwardly disposed lip of the wallwardmost extent of the lower end of the front component of the second half is oriented generally parallel to the wall mounting plate.

The mirror image side components of the second half each have a wallward end, a front end, an upper end, and a lower end. The mirror image side components of the second half each have an inner surface and an outer surface.

The front end of each second half side component is continuous with the side ends of the front component of the second half. The front end of each second half side component has an angled edge. The wallward end of each second half side component is generally linear. The upper end of each second half side component is generally perpendicular to each wallward end of the side component of the second half. The lower end of each second half side component has a generally linear edge. The lower end edge of each second half side component is generally perpendicular to each wallward end of the side component of the second half. The lower wallward end of each side component of the second half has a locking bar aperture there through.

The inner surface of each of the side components of the second half have locking pins located there on. The locking pins engage the offset slots of the side components of the first half.

There is a display window holder. The display window holder is fabricated of a rigid material. The display window holder has a generally rectilinear configuration. The display window holder has a wallward surface, an outer surface, an upper edge, and a lower edge. The display window holder has a pair of generally parallel side edges with a thickness there between.

The display window holder wallward surface has a pair of studs thereon, with the studs each having an associated wing nut. Each of the side edges of the display window holder each have a wallwardly oriented lip and a pair of apertures there through.

There is a display window. The display window is fabricated of a generally transparent material. The display window has a generally C-shaped configuration, with a pair of mirror image recesses there in. The recesses of the display window are configured to slidably receive the upper edge and the lower edge of the display window holder.

There is a contents viewing window. The contents viewing window is fabricated of a transparent material. The contents viewing window has a generally rectangular configuration with an outward surface and a wallward surface, with a thickness there between. The contents viewing window has an upper edge and a lower edge. The upper and lower edges of the contents viewing window each have a stud slot therein. The stud slot of the contents viewing window are configured to receive the stud of the inner surface of the lip of the lower end of the front component of the second half. The contents viewing window is contained by the treaded stud associated wing nuts of the lip of the lower end of the front component of the second half and the inner surface lip of the lower end of the front component of the second half.

Lastly, there is a locking bar. The locking bar has a generally rectilinear configuration. The locking bar is fabricated of a rigid material. The locking bar has an upper edge and a lower edge, with a height there between. The locking bar has a first side end and a second side end, with a length there between. The locking bar first side end has a lock hole there through. The locking bar second side end has a bend there in. The bend of the locking bar forms a generally right angle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collection canister which has all of the advantages of the prior art devices to collect contributions and none of the disadvantages.

It is another object of the present invention to provide a new and improved collection canister which may be easily and efficiently manufactured and marketed.

It is further object of the present invention to provide a new and improved collection canister which is of durable and reliable constructions.

An even further object of the present invention is to provide a new and improved collection canister which is susceptible of a low cost of manufacture with regard to both materials and labor, and which accordingly is then susceptible of low prices of sale to the consuming public, thereby making such collection canister economically available to the buying public.

Even still another object of the present invention is to provide a collection canister which is an efficient and easy to use contributions collection device.

Lastly, it is an object of the present invention to provide a new and improved collection canister having a wall mounting plate having a baffle. The collection canister having a first half having a back component and a pair of side components. The first half being removably coupled to the wall mounting plate There is a second half having a front component and a pair of side ends. The second half is removably coupled to the first half in a clam shell manner. There is a locking bar which secures the plate and halves together. There is a contents viewing window and a display window, for advertising.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is a view of the collection canister taken along line 8-8 of FIG. 7.

FIG. 9 is a close up of a cross sectional view of the lower end of the canister, showing the locking bar channel, as well as the wing nut holding the contents viewing window. Note that the volume of the canister is restricted at the lower end of the canister. This narrowing enhances the appearance of contributions in the canister by making the contributions look to be more than they are. This manipulation enhances the public's desire to contribute.

The same reference numerals refer to the same parts throughout the various Figures.

DESCRIPTION OF THE PREFERRED EMBODIMENT

Figures 1, 2:
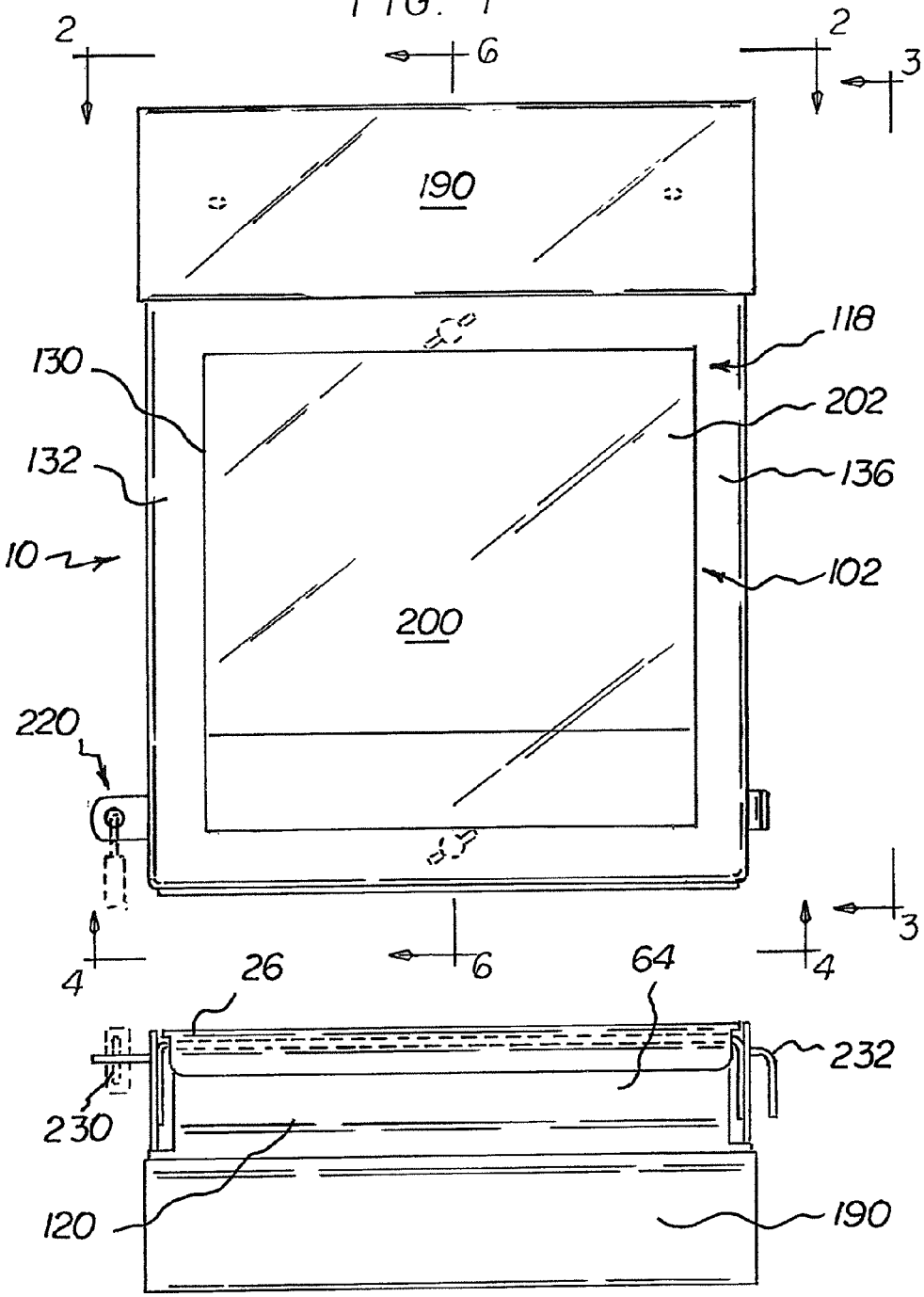
FIG. 1 is front elevational view of the collection canister.
FIG. 2 is a view of the collection canister taken along line 2-2 of FIG. 1.
Figure 3:
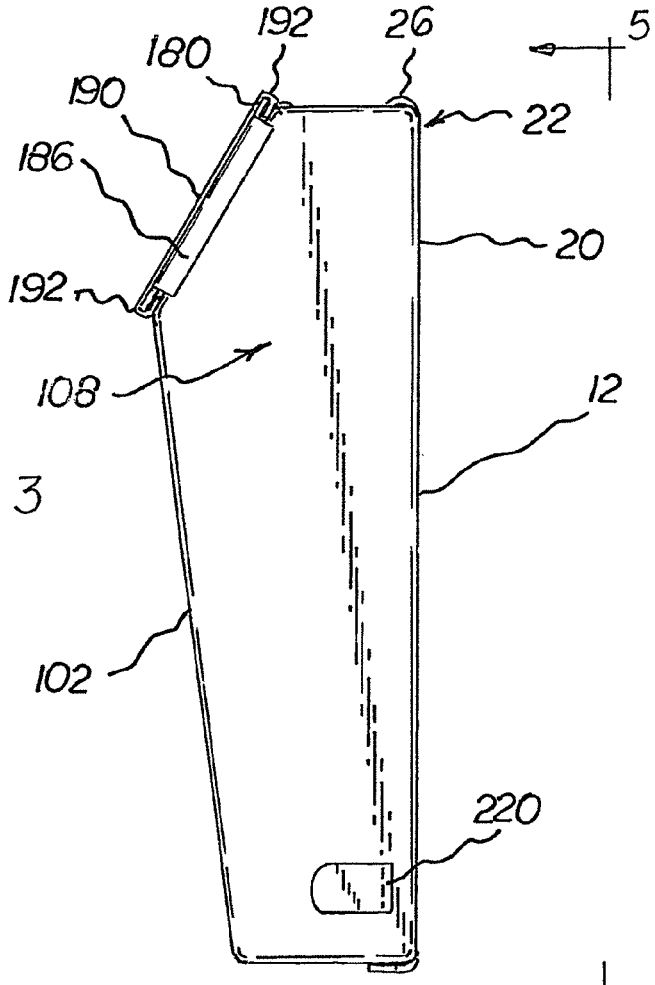
FIG. 3 is a view of the collection canister taken along line 3-3 of FIG. 1.
Figure 4:
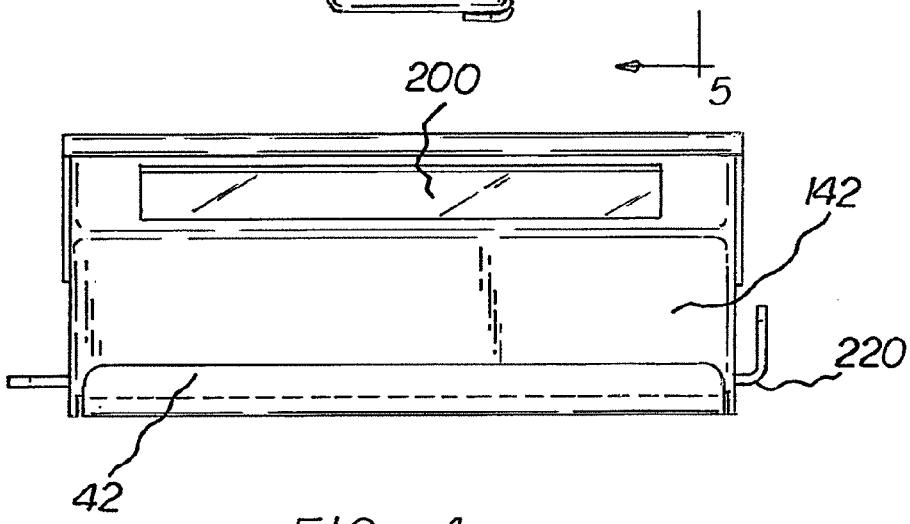
FIG. 4 is a view of the collection canister taken along line 4-4 of FIG. 1.
Figure 5:
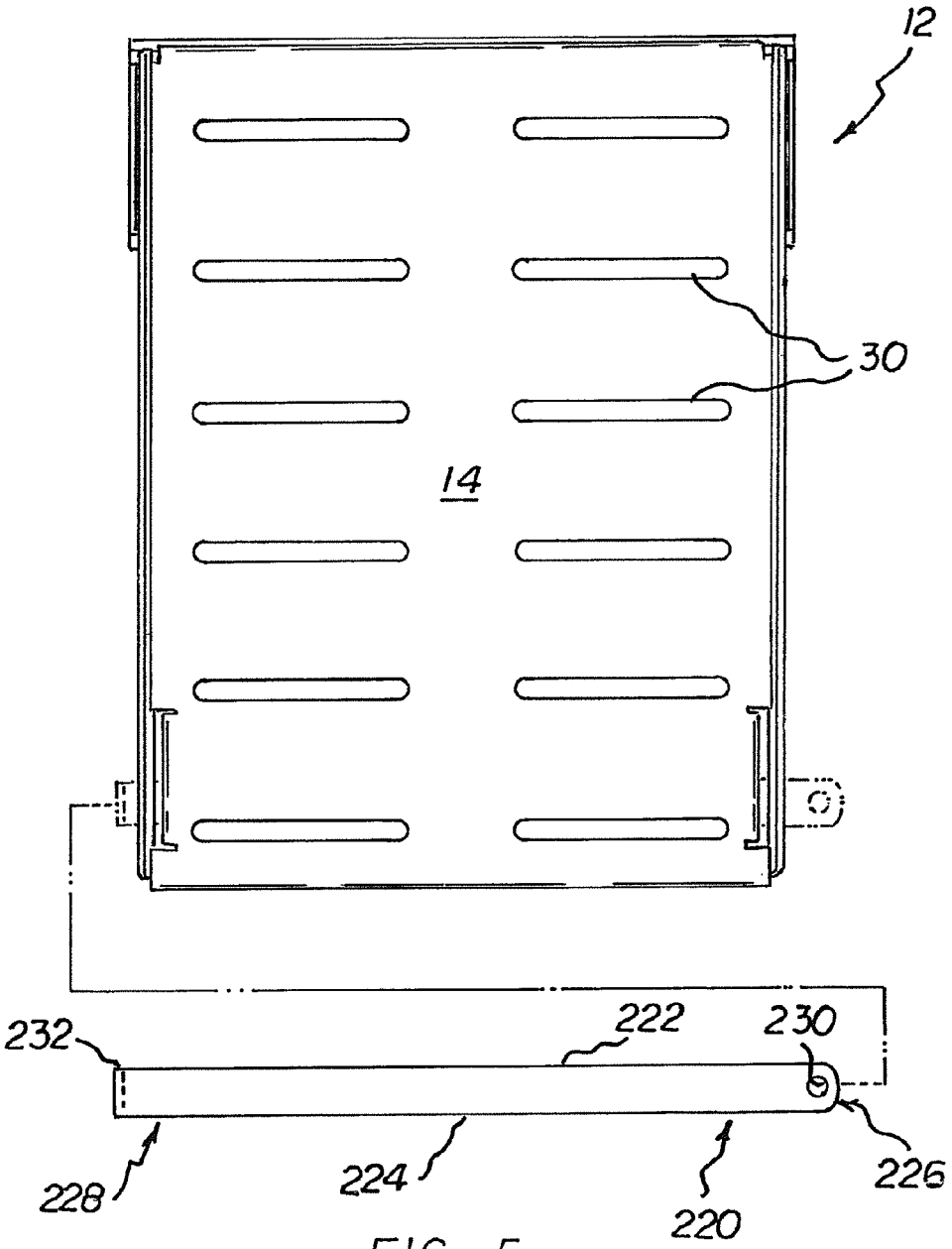
FIG. 5 is a view of the collection canister taken along line 5-5 of FIG. 13.
Figure 6:
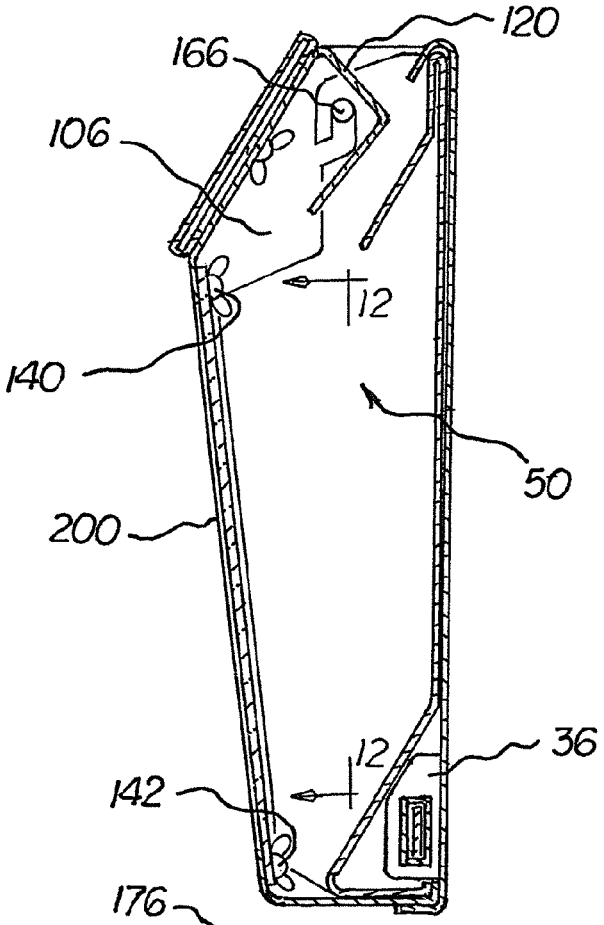
FIG. 6 is a view of the collection canister taken along line 6-6 of FIG. 1.
Figure 7:
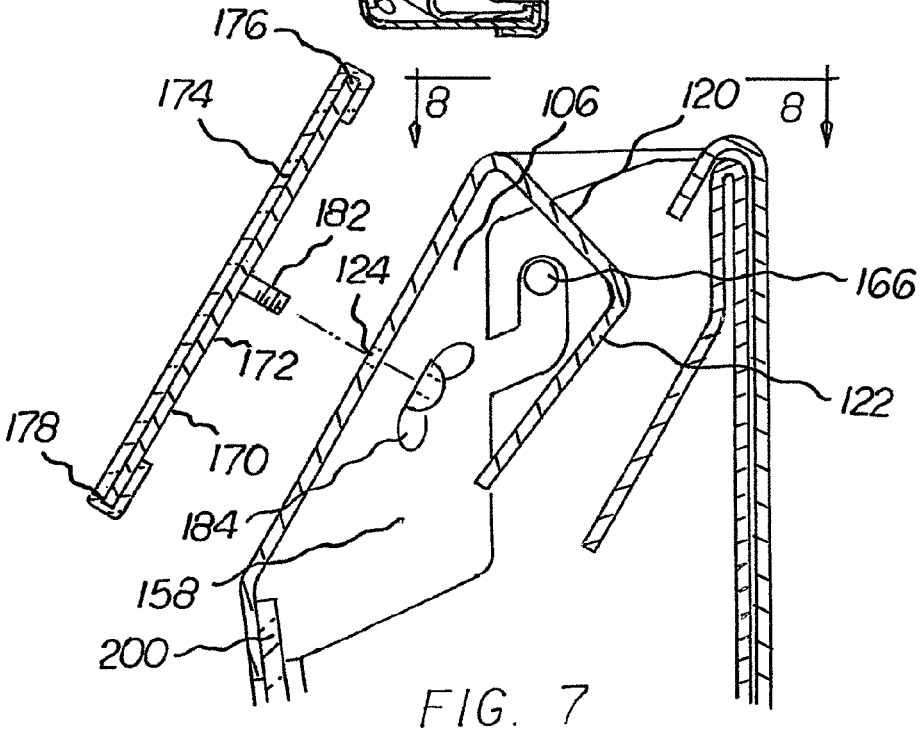
FIG. 7 is a close up of a cross sectional view of the upper end of the canister, showing the removed display window and display window holder.
Figure 10:
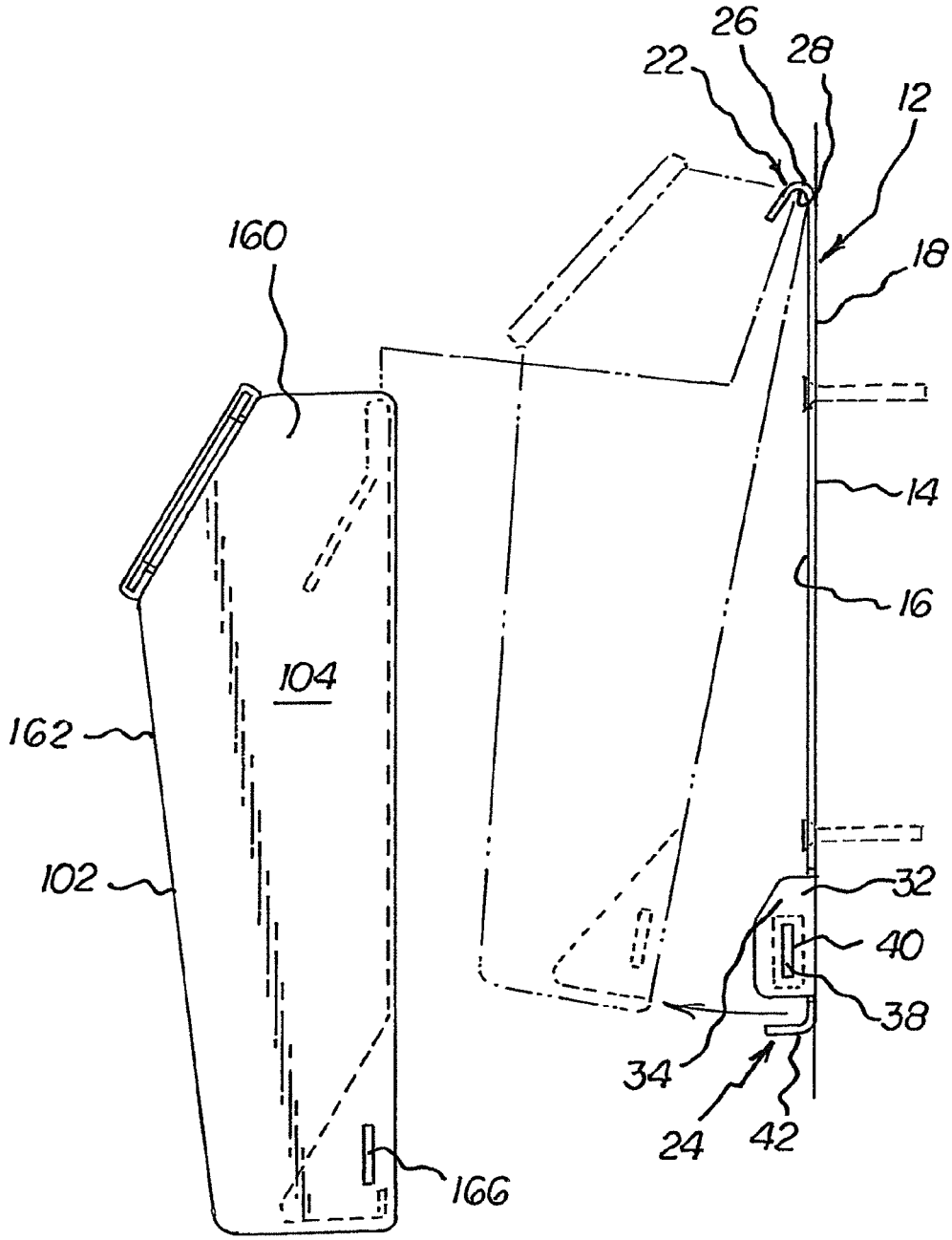
FIG. 10 is a side elevational view of the canister, showing how the canister is coupled to the wall mounting plate. Note that the movement is simple. The canister is pushed into and upward, and then rotated wallward. The locking bar is then inserted and the canister is secured to the wall mounting bracket.
Figure 11:
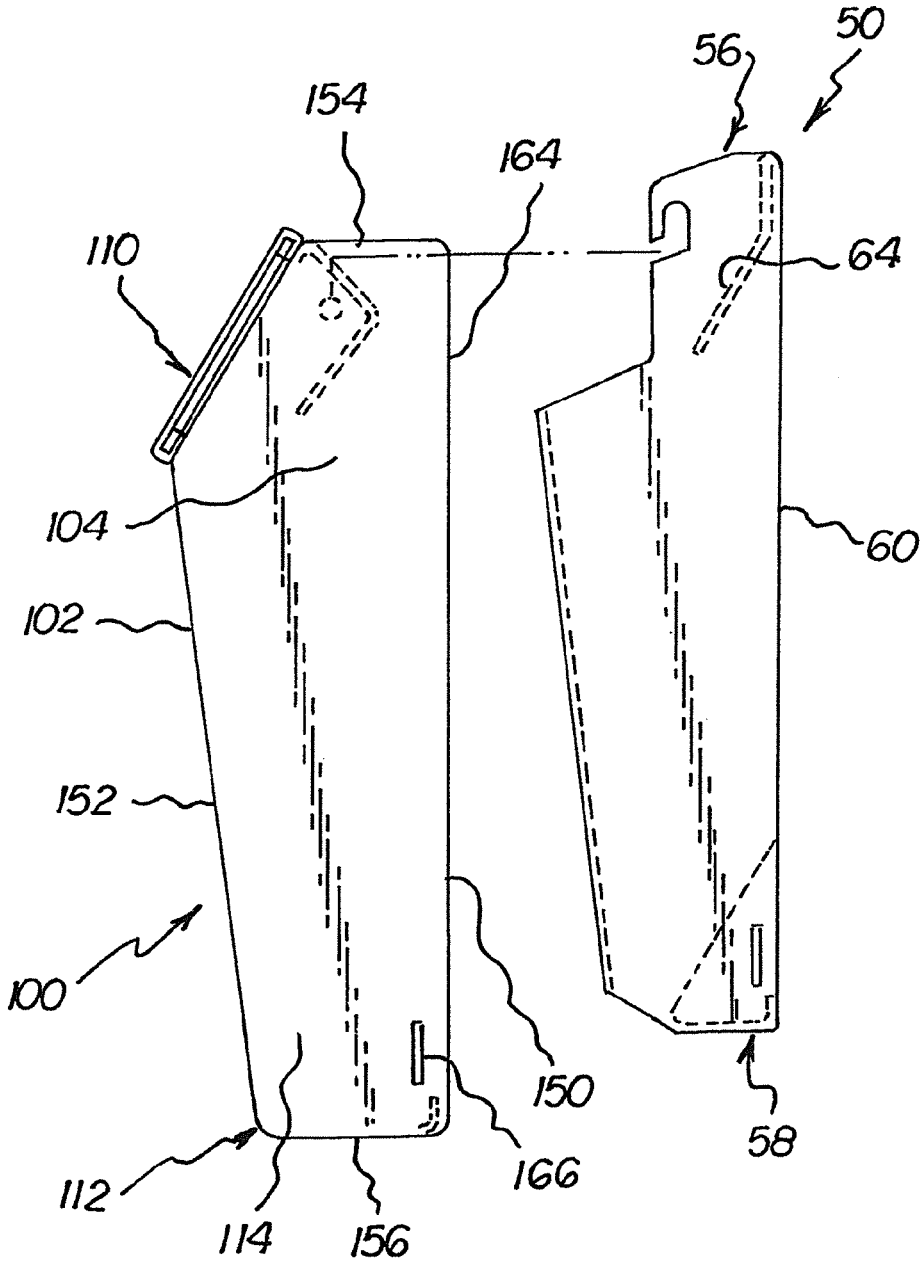
FIG. 11 is a side elevational view of the canister, showing how the first and second halves of the canister are coupled together. Note that the movement is also simple. The first half is pushed up, and then into the second half. The assembled first and second halves are then ready to be coupled to the wall mounting bracket, and locked in place using the locking bar.
Figure 12:
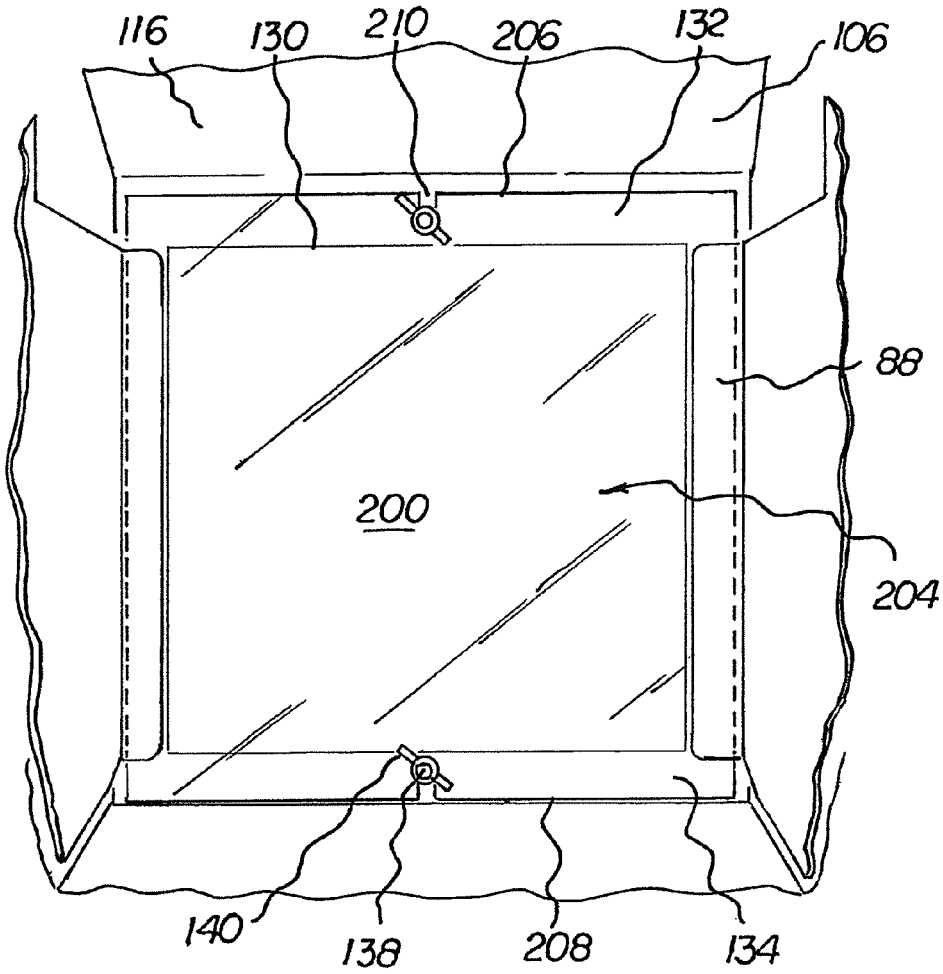
FIG. 12 is an interior view, from the inside of the canister, looking outward, through the contents viewing window. Note how the contents viewing window is held in position by the studs and wing nuts, as well as the inwardly oriented lips of the side components of the first half. This four sided securement prevents the window from being pushed in to allow access to the money contained within the collection canister.
Figure 13:
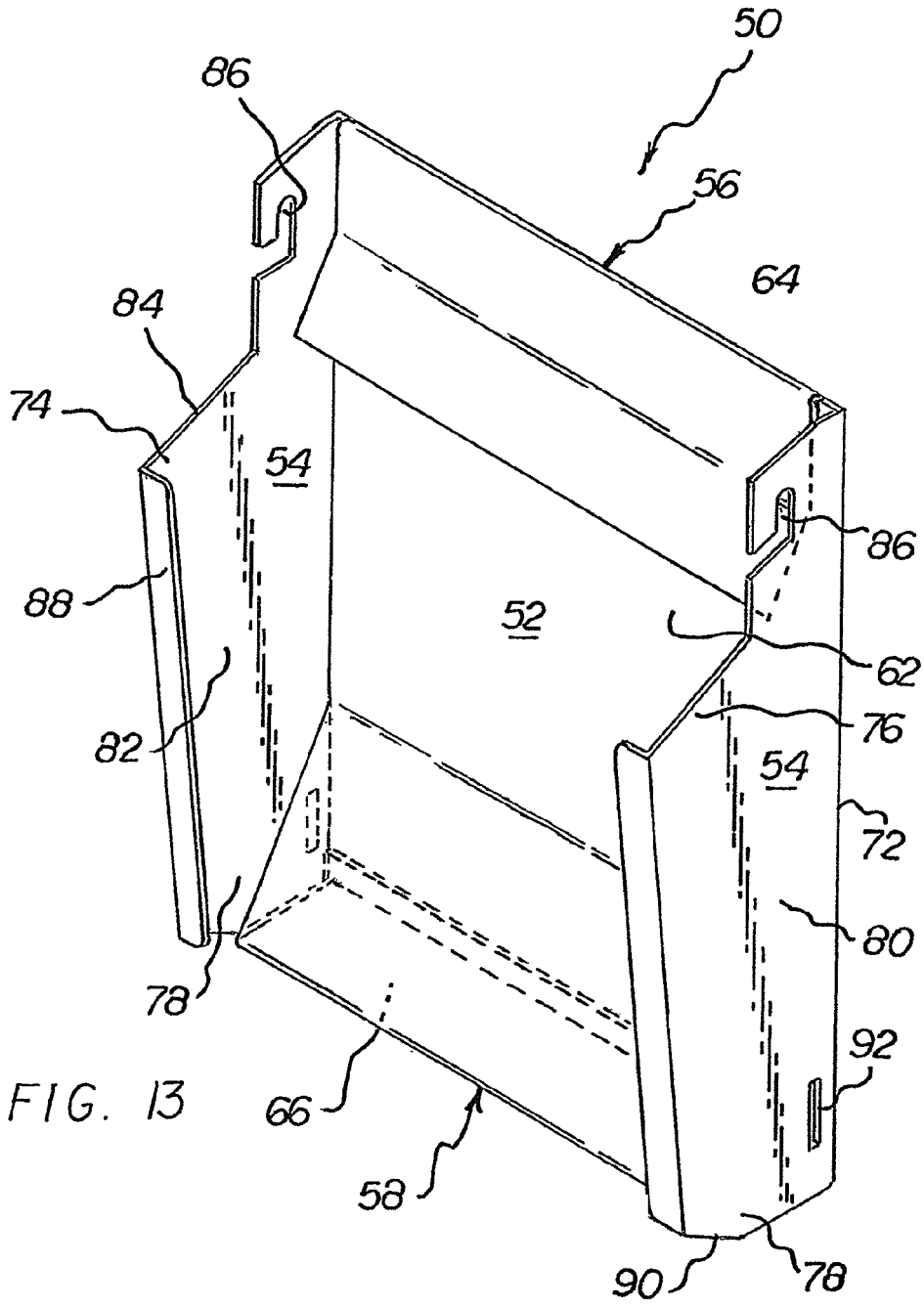
FIG. 13 is a perspective view of the first half. Note the baffle which, along with the second half, forms an angled money passageway.

With reference now to the drawings, and in particular to FIG. 1 thereof, the preferred embodiment of the new and improved collection canister embodying the principles and concepts of the present invention and generally designated by the reference numeral 10 will be described.

The present invention, the collection canister 10 is comprised of a plurality of components. Such components in their broadest context include a wall mounting plate, a first half, a second half and a locking bar. Such components are individually configured and correlated with respect to each other so as to attain the desired objective.

A collection canister 10 comprising, in combination is herein described.

There is a wall mounting plate 12. The wall mounting plate is fabricated of a rigid material. The wall mounting plate has a generally rectilinear configuration. The wall mounting plate has a wall contact surface 14 and an outward surface 16, with a thickness 18 there between. The thickness of the wall mounting plate forms a side edge 20. The wall mounting plate has an upper end 22 and a lower end 24, with a height. The wall mounting plate has a first width. The wall mounting plate upper end has an lip 26 which is angled downward between about five degrees and eighty degrees.

The lip of the wall mounting plate and the outward surface of the wall mounting plate form a recess 28 there between. The lip of the wall mounting plate has a second width, with the second width of the lip being less than the first width of the wall mounting plate.

The height of the wall mounting plate has a plurality of slots 30 there through. The lower end of the wall mounting plate has a pair of generally parallel outwardly extending tabs 32, with each tab having an outward side edge 34 and each tab having an inward side edge 36. Each tab has a locking bar aperture 38 there through. The distance between each outward tab side edge being the second width.

There is locking bar channel 40. The locking bar channel has a rectangular hollow tubular configuration. The locking bar channel is located between the inner side edges of each of the lower end tabs. The locking bar channel is fixedly attached to the tabs by way of a weldment. In variations of the attachment of the locking bar channel, the channel may be coupled to the wall mounting plate using screws, bolts, pins, clips or other methods commonly used to coupled parts together. The locking bar functions as a guide to allow for a continuous passageway between the tabs. In variations of the preferred embodiment, the locking bar channel may be omitted.

The lower end of the wall mounting plate has an outwardly disposed lip 42, with the lip having the first width. The outwardly disposed lip of the lower end of the wall mounting plate is oriented generally perpendicular to the outward surface of the wall mounting plate.

There is a first half 50. The first half is fabricated of a rigid material. The first half has a back component 52 and a pair of mirror image side components 54. The back component has a generally rectilinear configuration, with an upper end 56 and a lower end 58. The back component has an wallward surface 60 and an inner surface 62, with a thickness there between.

The term wallward is used to describe the orientation when the collection canister is affixed to a wall. If the orientation is toward the wall when installed, that orientation is described as wallward. If, on the other hand, the orientation is away from the wall, the direction is described as outward.

The upper end of the first half has an outwardly angled baffle 64 coupled there to with the angle of the outwardly angled baffle being between about five degrees and eighty degrees.

The lower end of the first half is oriented at an outward angle relative to the upper end of the first half, with the angle being between about five degrees and eighty degrees. The lower end of the first half has a wallwardly disposed strip 66, with the strip being disposed generally perpendicular to the upper end of the first half. The strip has a wallward extent 68, with the wallward extent having a generally upwardly disposed second lip 70. The second lip is oriented generally parallel to the upper end of the first half.

The mirror image side components each have a wallward end 72, an outward end 74, an upper end 76, and a lower end 78. Each side component has an outward 80 surface and an inner surface 82, with a thickness there between. The wallward end of each side component is continuous with the back component of the first half. The upper end of each side component has a stepped 84 configuration, with the step of each upper end of each side component having an offset slot 86 there through.

The outward end of each side component is located at an angle relative to the wallward end of each side component, with the side component outward end angle being between about ten degrees and forty five degrees.

Each side component outward end has an inwardly disposed lip 88, with the lip being oriented generally perpendicular to the wallward end of the side component. Each side component has a beveled outward lower end 90. Each side component wallward lower end has a locking bar aperture 92 there through.

There is a second half 100. The second half is fabricated of a rigid material. The second half has a front component 102 and a pair of mirror image side components 104. The second half has an inner surface 106 and an outer surface 108. The front component has a generally rectilinear configuration with an upper end 110, a lower end 112, and a pair of side ends 114. The front component has an inner surface 116 and an outer surface 118.

The term inner surface is used to refer to the interior surface of the canister.

The upper end of the front component of the second half is angled wallwardly 120 relative to the lower end of the second half. The upper end of the front component of the second half has a wallwardly angled and then outwardly angled baffle 122. The upper end of the front component of the second half has a pair of stud holes 124 there through.

The lower end of the second half is angled wallwardly relative to the wall mounting plate. The lower end of the front component of the second half has a rectangular shaped contents viewing aperture 130 there through. The contents viewing aperture having a surrounding lip 132, with the lip having an inner surface 134 and an outer surface 136. The inner surface of the lip of the lower end of the second half has a pair of threaded studs 138 located there on, with each of the threaded studs having an associated wing nut 140.

The lower end of the front component of the second half also having a generally rectangular shaped wallwardly disposed lip 142. The wallwardly disposed lip of the lower end of the front component having a wallwardmost extent 144 with an upwardly turned lip 146. The wallwardly disposed lip of the lower end is oriented generally perpendicular to the wall mounting plate. The upwardly disposed lip of the wallwardmost extent of the lower end of the front component of the second half is oriented generally parallel to the wall mounting plate.

The mirror image side components of the second half each have a wallward end 150, a front end 152, an upper end 154, and a lower end 156. The mirror image side components of the second half each have an inner surface 158 and an outer surface 160. The front end of each second half side component is continuous with the side ends of the front component of the second half. The front end of each second half side component has an angled edge 162. The wallward end of each second half side component is generally linear 164. The upper end of each second half side component is generally perpendicular to each wallward end of the side component of the second half. The lower end of each second half side component has a generally linear edge. The lower end edge of each second half side component is generally perpendicular to each wallward end of the side component of the second half. The lower wallward end of each side component of the second half has a locking bar aperture 166 there through.

The inner surface of each of the side components of the second half have locking pins 166 located there on. The locking pins engage the offset slots of the side components of the first half.

There is a display window holder 170. The display window holder is fabricated of a rigid material. The display window holder has a generally rectilinear configuration. The display window holder has a wallward surface 172, an outer surface 174, an upper edge 176, and a lower edge 178. The display window holder has a pair of generally parallel side edges 180 with a thickness there between.

The display window holder wallward surface has a pair of studs 182 thereon, with the studs each having an associated wing nut 184. Each of the side edges of the display window holder each have a wallwardly oriented lip 186 and a pair of apertures (not shown) there through.

There is a display window 190. The display window is fabricated of a generally transparent material. The display window has a generally C-shaped configuration, with a pair of mirror image recesses 192 there in. The recesses of the display window are configured to slidably receive the upper edge and the lower edge of the display window holder.

There is a contents viewing window 200. The contents viewing window is fabricated of a transparent material. The contents viewing window has a generally rectangular configuration with an outward surface 202 and a wallward surface 204, with a thickness there between. The contents viewing window has an upper edge 206 and a lower edge 208. The upper and lower edges of the contents viewing window each have a stud slot 210 therein. The stud slot of the contents viewing window are configured to receive the stud of the inner surface of the lip of the lower end of the front component of the second half. The contents viewing window is contained by the treaded stud associated wing nuts of the lip of the lower end of the front component of the second half and the inner surface lip of the lower end of the front component of the second half.

Lastly, there is a locking bar 220. The locking bar has a generally rectilinear configuration. The locking bar is fabricated of a rigid material. The locking bar has an upper edge 222 and a lower edge 224, with a height there between. The locking bar has a first side end 226 and a second side end 228, with a length there between. The locking bar first side end has a lock hole 230 there through. The locking bar second side end has a bend 232 there in. The bend of the locking bar forms a generally right angle.

There are five obvious advantages to the herein described collection canister.

First there are six interchangable components, being the wall plate, the first half, the second half the locking bar, the display, and the contents viewing window. Each of the interchangeable parts may be readily replaced should any one become damaged or unusable.

The second advantage is the ease of assembly over the prior art with the locking bar holding the entire canister locked to the wall plate and locked in a closed, operational, orientation, using a standard pad lock.

Third, the contents viewing window is held in position on the top and bottom by the two studs and wing nuts. Further, the contents viewing window is held between the first half and the second half by the inwardly disposed lip of each of the outward ends of the side components of the first half. The lip co-acts with the inner surface of the second component to fixedly hold the contents viewing window between the two structures, preventing anyone from pushing the window inward to access the collected money within. The relatively large window also allows the public to view the collected contributions, which enhances the desire of the public to further contribute.

Fourth, the display window co-acts with the display window holder to provide a secure location for the placement of advertising which is viewable to the public when the canister is mounted to a wall. As can be seen, the C-shaped channel in the display window receives the upper edge and the lower edge of the display window holder. When installed, the studs of the display window holder are tightened with the associated wing nuts. This tightening then binds the C-shaped channel between the display window holder and the upper end of the front component of the second half. This binding locks the display window in place, preventing removal or interference with any advertising which is placed between the display window and the display window holder.

Lastly, the clam shell configuration allows the baffle of the first half to co-act with the outwardly angled baffle of the second half to thereby prevent collected money from being dumped from the canister by inversion of the canister. The baffles form an angled passageway into the interior of the canister, providing for a more secured collection of money.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collection canister comprising, in combination:

a wall mounting plate having a wall contact surface and an outward surface with a thickness there between, the thickness of the wall mounting plate forming a side edge, the wall mounting plate having an upper end and a lower end with a height;

a first half having a back component and a pair of side components, the back component of the first half having a generally rectilinear configuration with an upper end and a lower end, the back component having an wallward surface and an inner surface with a thickness there between, each side component having a wallward end and an outward end and an upper end and a lower end, each side component having an outward surface and an inner surface with a thickness there between, the first half being removably coupled to the wall mounting plate;

each first half side component outward end having an inwardly disposed lip, a second half having a front component and a pair side components, the second half having an inner surface and an outer surface, the front component having a generally rectilinear configuration with an upper end and a lower end and a pair of side ends and an inner surface and an outer surface, the second half being removably coupled to the first half;

the wall mounting plate having a first width;

the upper end of the back component of the first half having an outwardly angled baffle coupled there to;

the lower end of the front component of the second half having a rectangular shaped contents viewing aperture there through with the contents viewing aperture having a surrounding lip with the lip having an inner surface and an outer surface;

a contents viewing window;

the wall mounting plate having a generally rectilinear configuration;

the first half side components being mirror images of each other;

the lower end of the back component of the first half being oriented at an outward angle relative to the upper end;

the second half side components being mirror images of each other;

the lower end of the wall mounting plate having a pair of generally parallel outwardly extending tabs;

the lower end of the back component of the first half having a wallwardly disposed strip with the strip having a wallward extent;

the upper end of the front component of the second half being angled wallwardly relative to the lower end of the second half; the mirror image side components of the second half each having a wallward end and a front end and a upper end and a lower end and an inner surface and an outer surface; and a display window holder having a wallward surf ace and an outer surface and an upper edge and a lower edge and a pair of generally parallel side edges with a thickness there between.

2. The collection canister as described in claim 1, with the canister further comprising:

the wall mounting plate upper end having an lip with the lip of the wall mounting plate and the outward surface of the wall mounting plate forming a recess there between;

each wall mounting plate tab having an outward side edge and each tab having an inward side edge;

the lower end of the wall mounting plate having an outwardly disposed lip;

the upper end of the front component of the second half having a wallwardly angled and then outwardly angled baffle;

a display window having a generally C-shaped configuration with a pair of mirror image recesses there in; and the contents viewing window having an upper edge and a lower edge and a pair of side edges.

3. The collection canister as described in claim 2, with the canister further comprising:

each wall mounting plate tab having a locking bar aperture there through;

the side components being mirror images of each other;

the outward end of each side component being located at an angle relative to the wallward end of each side component;

the inner surf ace of the lip of the lower end of the front component of the second half having a pair of threaded studs located there on with each of the threaded studs having an associated wing nut;

the front end of each second half side component having an angled edge;

the display window holder wallward surf ace having a pair of studs thereon with the studs each having an associated wing nut; and the contents viewing window upper edge and a lower edge each having a stud slot therein, the stud slots each being configured to receive the studs of the inner surface of the lip of the lower end of the front component of the second half, the contents viewing window being contained by the treaded stud associated wing nuts of the lip of the lower end of the front component of the second half and the inner surf ace lip of the lower end of the front component of the second half.

4. The collection canister as described in claim 3, with the canister further comprising:

the side component outward end angle being between about ten degrees and forty five degrees;

the lip of each first half side component outward end being oriented generally perpendicular to the wallward end of the side component;

the lower end of the second half front component being angled wallwardly relative to the wall mounting plate;

the lower wallward end of each side component of the second half having a locking bar aperture there through; and the recesses of the display window being configured to slidably receive the upper edge and the lower edge of the display window holder.

5. The collection canister as described in claim 4, with the canister further comprising:

the wall mounting plate upper end having a lip which is angled downward between about five degrees and eighty degrees;

the wall mounting plate having a locking bar channel having a rectangular hollow tubular configuration, the wall mounting plate locking bar channel being located between the inner side edges of each of the lower end tabs;

the lower end of the wall mounting plate outwardly disposed lip having the first width;

the upper end of each side component having a stepped configuration; and the lower end of the front component of the second half also having a generally rectangular shaped wallwardly disposed lip.

6. The collection canister as described in claim 5, with the canister further comprising:

the lip of the wall mounting plate having a second width, with the second width of the lip being less than the first width of the wall mounting plate;

the angle of the baffle of the upper end of the back component of the first half being between about five degrees and eighty degrees;

the outward angle of the lower end of the back component of the first half being between about five degrees and eighty degrees; the wallward extent of the lower end of the back component having a generally upwardly disposed second lip;

the step of each upper end of each side component of the first half having an off set slot there through;

the upper end of the front component of the second half having a pair of stud holes there through;

the side edges of the display window holder each having a wallwardly oriented lip and a pair of apertures there through; and a locking bar having an upper edge and a lower edge with a height there between, the locking bar having a first side end and a second side end with a length there between.

7. The collection canister as described in claim 6, with the canister further comprising:

the height of the wall mounting plate having a plurality of slots there through;

the distance between each outward tab side edge of the wall mounting plate being the second width;

the outwardly disposed lip of the lower end of the wall mounting plate being oriented generally perpendicular to the outward surface of the wall mounting plate;

each first half side component wallward lower end having a locking bar aperture there through;

the wallwardly disposed lip of the lower end of the front component of the second half having a wallwardmost extent; and the locking bar first side end having a lock hole there through.

8. The collection canister as described in claim 7, with the canister further comprising:

the locking bar channel of the wall mounting plate being located between the inner side edges of each of the lower end tabs of the wall mounting plate;

the lower end having a wallwardly disposed strip being disposed generally perpendicular to the upper end of the first half;

the wallwardly disposed lip of the lower end of the front component of the second half being oriented generally perpendicular to the wall mounting plate;

the front end of each second half side component being continuous with the side ends of the front component of the second half; and the locking bar second side end having a bend there in, the bend forming a generally right angle.

9. The collection canister as described in claim 8, with the canister further comprising:

the wall mounting plate being fabricated of a rigid material; the locking bar channel being fixedly attached to the tabs by way of a weldment;

the first half being fabricated of a rigid material;

the second lip of the wallward extent of the lower end of the back component being oriented generally parallel to the upper end of the first half;

the wallward end of each side component of the first half is continuous with the back component of the first half;

each first half side component having a beveled outward lower end;

the second half being fabricated of a rigid material;

the wallwardmost extent of the wallwardly disposed lip of the lower end of the front component of the second half having an upwardly disposed lip;

the display window holder being fabricated of a rigid material;

the display window fabricated of a generally transparent material; and the locking bar being fabricated of a rigid material.

10. The collection canister as described in claim 9, with the canister further comprising:

the upwardly disposed lip of the wallwardmost extent of the lower end of the front component of the second half being oriented generally parallel to the wall mounting plate;

the wallward end of each second half side component being generally linear, with the upper end of each second half side component being generally perpendicular to each wallward end of the side component of the second half, the lower end of each second half side component having a generally linear edge, with the lower end edge of each second half side component being generally perpendicular to each wallward end of the side component of the second half;

the display window holder having a generally rectilinear configuration;

the wallwardmost extent of the lower end of the front component of the second half having an upwardly disposed lip; and the locking bar having a generally rectilinear configuration.

* * * * *